United States Patent [19]

Coe

[11] Patent Number: 4,518,281

[45] Date of Patent: May 21, 1985

[54] ICE SUPPRESSION MAT

[76] Inventor: Thomas J. Coe, 86 Nicholas Ave., Groton, Conn. 06340

[21] Appl. No.: 567,408

[22] Filed: Dec. 30, 1983

[51] Int. Cl.[3] ..... E02B 15/02; E02D 5/60; B32B 3/02

[52] U.S. Cl. ..... 405/61; 4/504; 405/216; 428/65; 428/78; 428/115; 428/137; 428/304.4

[58] Field of Search ..... 405/61, 211, 216; 428/55, 56, 64, 65, 115, 137, 155, 304.4, 314.4, 314.8, 319.7, 77, 78; 4/504, 661

[56] References Cited

U.S. PATENT DOCUMENTS 4,049,852 9/1977 Smith, Jr. et al. ..... 428/55

4,179,319 12/1979 Lofdahl ..... 428/137

4,208,469 6/1980 Dial ..... 428/319.7

*Primary Examiner*—William J. Van Balen

*Attorney, Agent, or Firm*—McCormick, Paulding & Huber

[57] ABSTRACT

A laminated ice suppression mat which prevents ice from forming adjacent to objects partially submerged in a body of water subject to natural icing conditions has a laminate of buoyant, thermal insulating material intimately joined to a larger laminate of a reinforcing material. A fringe of reinforcing material may become embedded in an ice sheet which forms around the mat and causes the mat to move upward and downward about the object as the ice sheet rises and falls with the changes in water level.

19 Claims, 10 Drawing Figures

ICE SUPPRESSION MAT

BACKGROUND OF THE INVENTION

The present invention relates generally to ice protection devices and deals more particularly with an ice suppression mat for preventing an ice formation from adhering to and the subsequent jacking out or pushing over of a marine pile or like object as a result of vertical and lateral forces developed by the ice formation.

Severe damage may be caused to marine piles, boats, piers, docks and like objects which are partially submerged in a body of water subject to natural icing conditions. Such conditions occur, for example, in the Northeast and Great Lakes regions of the United States where fresh and brackish water routinely freezes over coastal waters. As the water freezes, an ice plate or sheet forms and collects on or adheres to objects in the water. Powerful vertical and lateral forces are exerted on those objects when there is a change in water level or horizontal ice expansion. Tests have shown that ice can withstand a force perpendicular to the ice surface of 500–1100 PSI and a force parallel to the ice surface of 250–900 PSI before compressive failure occurs.

When an object, such as, for example, a marine pile is frozen in a sheet of ice and the water level changes due to tidal and/or seiche action, the buoyancy of the ice sheet exerts vertical forces on the pile until the ice either breaks or overcomes adhesion to the pile and slides up. In many instances, the ice sheet surrounding the pile does not break or lose its hold and lifts the pile from the sea bed as the water level rises and returns it to its original position when the water level falls. However, sand or mud often fills the hole beneath a pile lifted by the ice during a high water level so that the pile cannot return to its original position when the water level falls. The repeated action of lifting a pile and filling its hole will jack the pile upward causing the pile to be at an elevation that is higher than its initial elevation. In some cases, the pile may be pushed over by lateral forces as the ice expands horizontally and in some instances, may be jacked completely out of its hole in the sea bed whereupon a structure, for example, such as a pier or dock, supported by the pile may collapse or be extensively damaged. Single pile applications such as small boat anchors and single pile navigational aids are also subject to being destroyed or removed and lost due to the ice forces which jack them out. The result of this damage is high repair costs to re-drive piles and re-build piers or other structures.

It is well known that the density of water decreases as it cools until it reaches 4 degrees Celsius at which time as cooling continues, the water expands so that the colder water floats above the warmer water strata below and it is this well recognized phenomenon which causes water to freeze from the surface downwardly. Obviously, the water in the lower strata must be above freezing at all times otherwise this water would freeze in the same manner as the surface water. Consequently, ice formation can be prevented by insulating the surface of the water from the colder air above it.

There have been many devices proposed and utilized to prevent ice from forming on marine piles. These devices, however, have not proved to be completely cost effective or otherwise satisfactory because they are often difficult to place in position or have limited applications.

One means for preventing ice damage has been by the use of a network of tubes which lay on the water's bottom and are supplied with compressed air to create air bubbles throughout the area to be maintained ice free. The air bubbles rise toward the surface bringing the lower, warmer water to the surface where it combines with the colder surface water to raise its temperature above freezing. The bubble system is effective in preventing ice formation but it is relatively expensive to purchase and operate and subject to corrosion and other degradation resulting from prolonged submergence, particularly in highly saline waters. The bubble system is also restricted to areas where electricity is available and consequently, cannot generally be used in remote areas.

U.S. Pat. No. 3,370,432 issued to Butler discloses a sheath surrounding a piling to be protected wherein an antifreeze solution is placed bewtween the piling and the sheath so that ice cannot form around the piling. The sheath will rise and fall with the tide, however, such apparatus is generally dropped in position over the top of the pile prior to the placement of a structure thereon. The antifreeze is also subject to dissipation as it is absorbed by the pile or otherwise dispersed.

U.S. Pat. No. 3,317,299 issued to Clark discloses a device in the form of a sheath situated around a pile and extending from above the high water line to well below the point at which ice freezes. An insulating material is carried in a ring at the upper portion of the sheath and extends from slightly above the water surface to a depth below that at which ice is expected to freeze so that heat is conducted by the sheath from the lower warmer water strata to the upper colder water strata and prevents freezing.

U.S. Pat. No. 3,180,099 issued to Mikolajczyk, et al discloses a pile protector in the form of a vertically slidable sheath positioned around a pile and containing an inner lining of material having a low coefficient of friction. The sheath extends below the point at which ice forms and also above the high water line. A spring is placed between the top of the sheath and the bottom of a dock or pier supported by the pile and thus, when ice is frozen around the sheath and the tide is rising, the sheath moves upwardly and compresses the spring. When the tide lowers, the spring returns the sheath to its original position and therefore, the sheath moves up and down around the pile preventing any upward force on the pile itself.

The Dow Chemical Company has conducted experiments utilizing a large foam mat in a dockside area to insulate the water below the mat from the colder air above and prevent ice formation in a large area adjacent to a dock. The mat, however, was difficult to place in position and anchor. In addition, the mat was not able to resist damage caused by high winds.

Accordingly, it is the general aim of the present invention to provide an effective and economical ice suppression mat for preventing ice formations from collecting on and jacking out a pile.

It is another aim of the present invention to provide an ice suppression mat that is easy to use with single or multiple pile configurations and with pilings having structures attached thereto.

A further aim of the present invention is to provide an ice suppression mat that is effective over a wide range of ice depths.

Other features and advantages of the invention will become apparent from the following written description and the drawings forming a part thereof.

SUMMARY OF THE INVENTION

In accordance with the present invention, an ice suppression mat is provided which prevents ice from forming adjacent to objects partially submerged in a body of water subject to natural icing conditions. The mat includes a first laminate which has one or more layers of a buoyant, thermal insulating material and forms a first sheet that has a first predetermined surface area. A second laminate has one or more layers of a flexible, tear resistant reinforcing material and forms a second sheet that has a second predetermined surface area. The reinforcing sheet is intimately joined to the insulating sheet to form a laminated and reinforced mat. The surface area of the second sheet is larger than the area of the first sheet to form a fringe around the perimeter of the first sheet. The fringe may become embedded in an ice sheet which forms around the mat and causes the mat to move upward and downward about the object as the ice sheet rises and falls with changes in water level.

The invention further resides in the laminated mat having a centrally located opening through the first and second laminates to accommodate a protected object and to permit the mat to move freely with respect to the object as the water level rises and falls. Means defining a slit extend radially outward for a predetermined distance from the central opening to allow deformation of the mat edges at the central opening as the mat moves over irregularities and ice formations which may be on the protected object.

DETAILED DESCRIPTION

Figure 1:
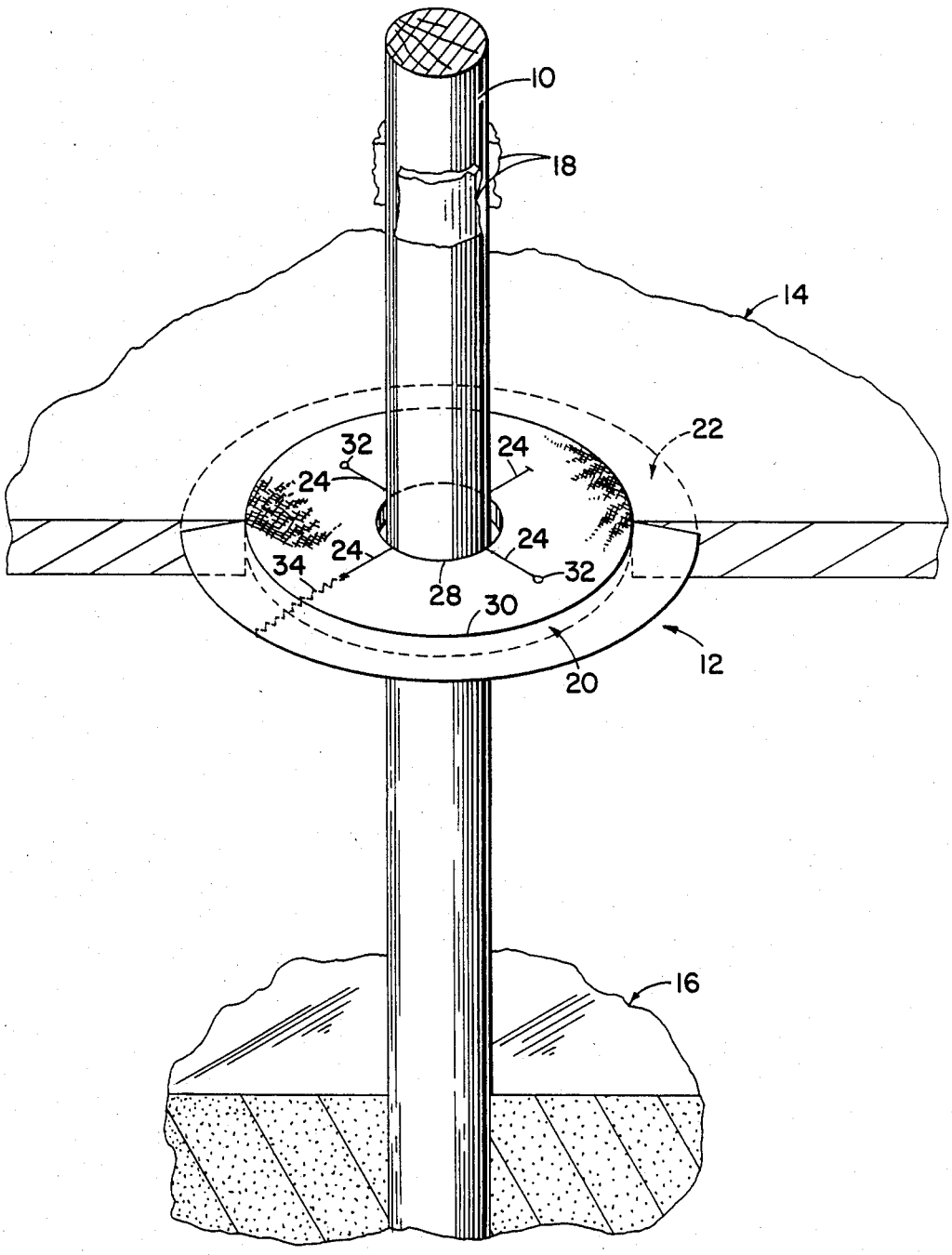
FIG. 1 shows a perspective view of a marine pile and an ice suppression mat in one embodiment of the present invention.

Referring now to the drawings and particularly to FIG. 1, a conventionally driven marine pile generally designated by the numeral 10 located in waters subjected to destructive icing conditions is shown mounted in a sea bed 16. A marine pile protection device or laminated ice suppression mat constructed in accordance with the invention is indicated generally by the numeral 12. The ice suppression mat 12 floats on the water and surrounds the pile to be protected. The mat 12 prevents ice from forming around the pile 10 by insulating the water below it from the colder air above. An ice sheet designated generally by the numeral 14 forms on the water during freezing weather conditions and surrounds the ice suppression mat 12 and the pile 10. However, because ice is not formed under the mat 12 the ice sheet 14 is prevented from reaching and adhering to the pile 10. Consequently, the vertical and lateral ice forces which tend to jack and push a pile out of the sea bed 16 as the water level and accordingly, the ice sheet 14 rise are eliminated.

Figure 2:
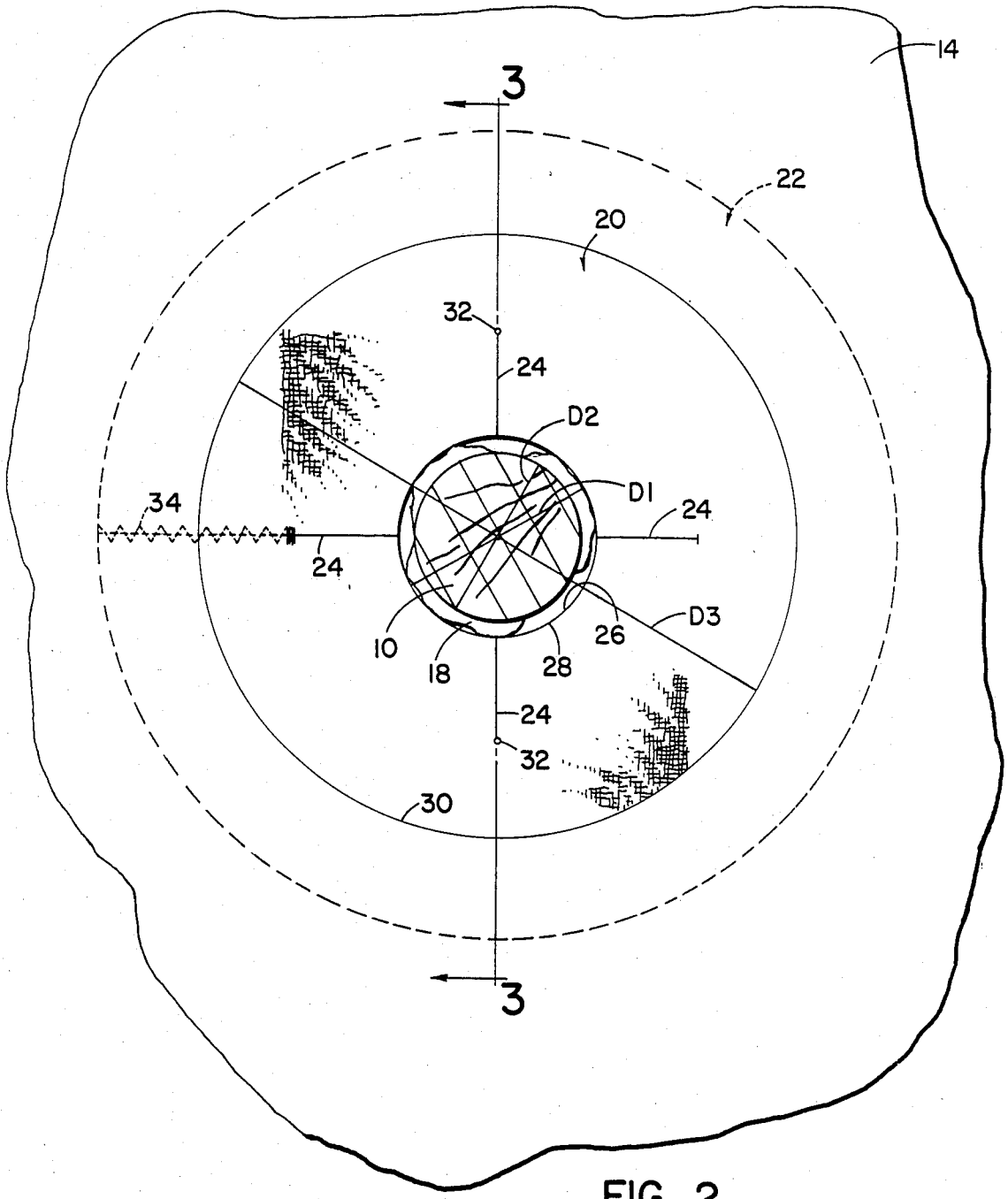
FIG. 2 shows a top plan view of the ice suppression mat of FIG. 1, FIGS. 3A–3C show cross-sectional views taken along the line 3—3 of FIG. 2 and illustrate the deformation of the ice suppression mat at the pile/ice collar interface as the mat slides over an ice collar with changes in water level.

As best viewed in FIG. 2, the ice suppression mat 12 is preferably circular although any shape can be used. The mat 12 has a centrally located opening or hole 26 to allow the mat to be placed in a coaxial arrangement with a pile 10 so it may move axially in an upward and downward direction along the pile. The diameter designated as D1 of the hole 26 should be slightly larger than the protected pile diameter designated as D2 to form an annular space therebetween and preferably diameter D1 is two inches larger than the diameter of the pile as measured at the high water mark.

An ice collar 18 as illustrated in FIG. 1 is shown above the ice suppression mat 12 and for explanation purposes is presumed to have formed during a previously occurring higher water level, such as, for example, a high tide. Ice collars form around a pile 10 at and below the water surface due to the pile conducting heat from the water and lowering the temperature of the water in contact with the pile. Such heat loss generally cannot be prevented by the ice suppression mat 12. The formation of ice collars is more prevalent on steel piles than wood piles because steel is a better thermal conductor than wood and therefore more readily conducts heat from the water. Consequently, the mat 12 must also be able to slide over and bend around the ice collar 18 as the water level rises and falls.

Now considering the invention in further detail and referring to FIGS. 1 and 2, the ice suppression mat 12 comprises a lower laminate or layer 20 of a water impervious, thermal insulating, buoyant material that is resistant to tearing and has low ice adhesion characteristics. The material is also preferably flexible to allow bending and deformation at the pile/ice collar interface as the mat 12 slides over the ice collar 18. The thickness of the insulating layer 20 should not impair the flexibility of the mat 12 or its ability to slide over the ice collar 18 but should however, be of a sufficient insulating capability to effectively insulate the water below from the cold air above to prevent ice formation. The actual thickness selected is dependent upon many conditions such as water salinity, water movement beneath the mat, the duration and severity of the cold air temperatures and the insulating charateristics of the insulating material used. Higher salinity and faster water movement beneath the mat generally allows for a thinner insulating material than a lower salinity or stagnant body of water.

I have found that a two inch thickness of a closed cell, polyethylene foam such as "Ethafoam 400" manufactured by the Dow Chemical Company is generally suitable to prevent ice formation for most weather conditions and exhibits the desired characteristics described above. The preferred polyethylene foam has a density of four pounds per cubic foot and is very strong having a tensile strength of 65 PSI and a tear strength of 25 pounds per inch. The insulating characteristics are also very good exhibiting a thermal conductivity of 0.4 (BTU-in/hr square foot degree F.).

The diameter generally designated as D3 of the insulating layer 20 is also dependent upon climatic conditions as discussed above and the diameter D2 of a pile 10 to be protected. Tests have shown that generally for most climatic conditions ice will not form below the mat 12 when the diameter D3 is at least three times the diameter D2 of the pile 10.

The ice suppression mat 12 also includes an upper laminate or reinforcing layer 22 which is intimately joined by an adhesive or other appropriate joining method such as, for example, mechanical or chemical bonding to the upper surface or side of the insulating layer 20 exposed to the air. The resulting laminated structure is considerably stronger, more durable and able to withstand greater tearing forces than the insulating layer 20 by itself. The reinforcing layer 22 is larger than the insulating layer 20 and forms a fringe which extends beyond the outer edge 30 of the insulating layer a distance of at least six inches. The fringe becomes embedded in the surrounding ice sheet 14 during ice formation and functions to anchor the ice suppression mat 12 to the ice sheet so that as the ice sheet rises and falls with changes in water level the mat 12 will also rise and fall with the ice sheet and not become stuck or caught on the pile 10 or the ice collar 18.

The material comprising the reinforcing layer 22 is resilient, flexible and of sufficient strength to permit bending and deformation of the ice suppression mat 12 while being able to resist tearing forces during the bending process as the mat slides over an ice collar 18 and "holds" onto the ice sheet 14. Tear resistant materials such as polyethylene netting, wire mesh screening, nylon, polypropylene and other synthetic compositions, fish netting and reinforced plastic carpeting may be used successfully for the reinforcing layer 22.

Figure 3A:
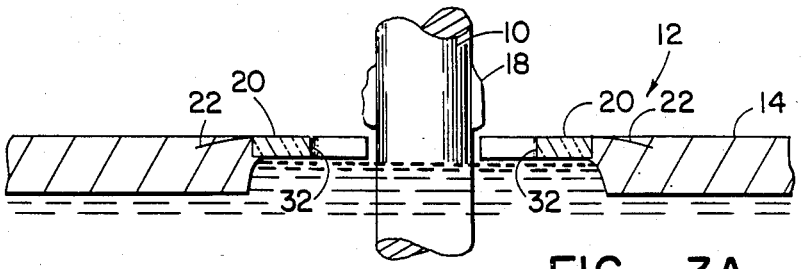
Figure 3B:
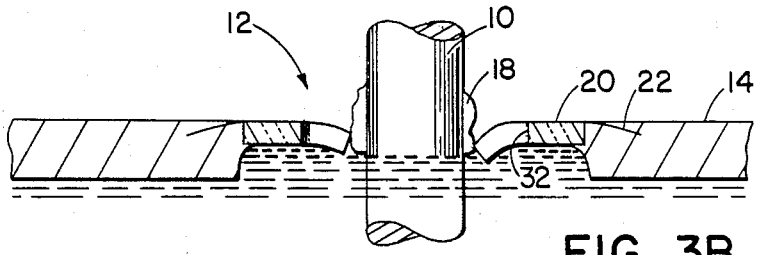

Referring again to FIGS. 1 and 2, a number of outwardly projecting radial slits 24,24 are cut through the ice suppression mat 12 to form pie-shaped segments which provide a greater degree of flexibility for bending and deformation at the pile/ice collar interface as particularly illustrated in FIG. 3B as the mat 12 slides over an ice collar 18. The slits 24,24 are cut at right angles relative to one another and preferably extend from an outermost edge 28 of the hole 26 outwardly for a distance equal to 1.5 times the diameter D1 of the hole. The length of the slits 24,24 should not, however, extend more than ½ the distance from the edge 28 to the outer edge 30 of the insulating layer 20. With this configuration the slits permit the mat 12 to slide over ice collars having a diameter greater than the hole 26 diameter D1 and allow the segments of the mat 12 to move up and down relative to one another at the pile/ice collar interface. Holes 32,32 having a one-half inch diameter extend through the mat 12 and are located at the ends of radial slits 24,24. The holes 32,32 function to relieve stresses which occur at the ends of the slits 24,24 during bending. Such relief increases the ability of the mat 12 to resist tearing and increasing the length of the slits 24,24 which would result in a weakening of the mat.

Figure 3C:
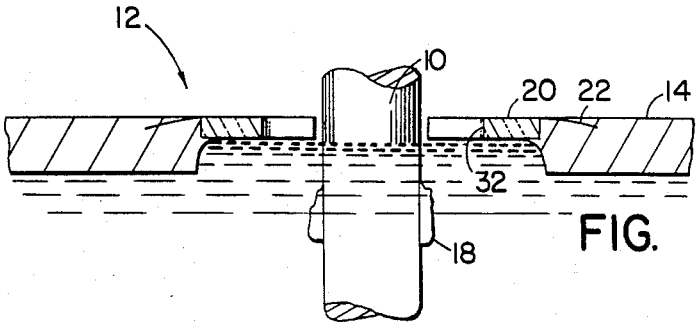

Turning now to FIGS. 3A–3C, collectively referred to as FIG. 3, cross-sectional views of the ice suppression mat 12 of FIG. 2 taken along the line 3—3 are illustrated. The sequence of illustrations beginning with FIG. 3A and proceeding to FIG. 3C is representative of the way in which an ice suppression mat 12 held in a surrounding ice sheet 14 slides upwardly along a pile 10 as the water level changes, for instance, from a low tide to a high tide. FIG. 3A illustrates the mat 12 held in a ice sheet 14 wherein an ice collar 18 is present on the pile 10 from a previous high tide. As the water level starts to rise, the ice sheet 14 and accordingly the ice suppression mat 12 also start to rise. When the mat 12 comes in contact with the ice collar 18 attached to the pile 10 as depicted in FIG. 3B, bending and deformation occurs at the ice collar/mat interface and at various locations radially outward from the interface as the mat slides over the ice collar. As shown in FIG. 3B, the bending and movement of the mat segments relative to one another as described above may be extreme as the mat 12 passes over the ice collar 18. FIG. 3C shows one possible position of an ice sheet 14 and ice suppression mat 12 above a previously formed ice collar 18 as they might be positioned after the occurance of a high tide.

Figure 7:
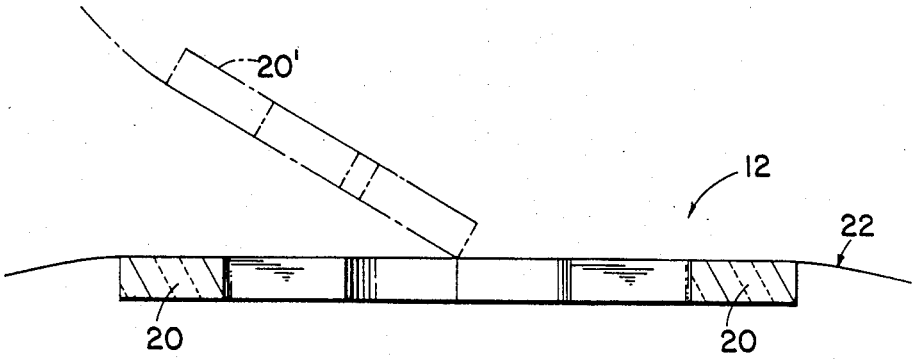
FIG. 7 shows a sectioned side elevation view of the ice suppression mat of FIG. 1 with one half of the mat folded upon itself in a phantom position.

Due to the unique laminated construction used for the ice suppression mat 12 to enhance its durability and resistance to destructive forces produced during icing conditions, the mat may be expected to be reused for a number of seasons. In order to facilitate the removal during warm weather when other, more permanent ice protectors obstruct the water about a protected pile and to minimize the storage space requirements for the ice suppression mat 12 when not in use and to facilitate deployment about an object as described hereinbelow, the mat may be modified to allow for folding in half, or as in the illustrated case, into a semicircular section as explained in the following description. Referring to FIG. 7, a sectioned side elevation view of an ice suppression mat 12 is shown wherein the insulating layer 20 is cut transversely in such a way that the reinforcing layer 22 is not cut and two half sections or semicircular sections are formed by the insulating layer 20. The reinforcing layer 22 functions as a hinge along the transverse cut and is referred to as a half section seam. The mat 12 folds in upon itself as shown in the phantom position of FIG. 7. The cut through the insulating layer 20 is preferably made along a half section seam coincident with two radial slits 24,24 positioned at 180 degrees to each other to allow the mat to retain maximum strength by minimizing the number of cuts in the insulating layer.

Although the ice suppression mat 12 may be slipped over the top of a pile to be protected, an important feature of the mat permits it to be used, for example, with a pile that protrudes above the surface of the water beyond easy reach or one that has some other structure mounted thereon. The deployment of the mat in these cases is accomplished in the following manner.

Referring to FIGS. 1 and 2, the insulating material 20 is cut along a half section seam coincident with two opposing radial slits 24,24 as explained hereinabove. The reinforcing layer 22 is also cut along the half section seam to extend one of the radial slits from the edge 28 of hole 26 to the outer periphery of the reinforcing layer. The mat 12 is folded in on itself along the half section seam using the uncut part of the reinforcing layer 22 as a hinge so that the portions of the mat between the hole 26 and the outer periphery are more readily spread open along the cut part of the half section seam. The spread portions of mat 12 may now be more easily positioned around the pile 10 or other object to be protected. The pile 10 and the mat 12 are moved relative to one another so that the pile moves between the spread portions of the mat and the mat moves into enveloping relationship with the pile. The pile 10 is situated between the half sections and extends through the center hole 26. The mat 12 is unfolded so that the two half sections lie generally in a common plane and surround the pile 10 extending through the center hole 26. The unfolded mat 12 can now float on the water with the reinforcing layer 22 exposed to the air. The reinforcing layer 22 is restitched or otherwise fastened together along the half section seam to once again form a continuous surface around the pile 10 as shown. The restitched seam is illustrated generally by the numeral 34 and the seam extends from the outer periphery of the reinforcing layer 22 inward toward the center hole 26 for a distance that will leave the radial slit 24 along the cut equal in length to the other radial slits 24,24. Light line such as polypropylene string or other suitable fastening means can be used for stitching the cut seam together.

Figure 4:
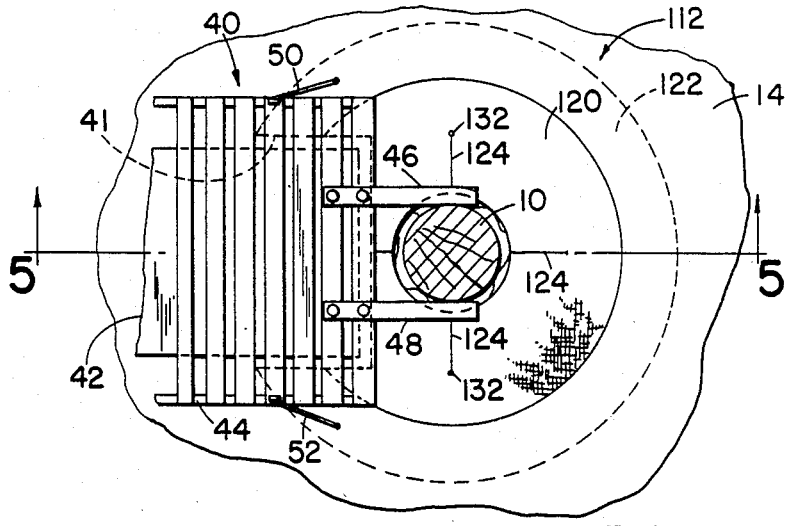
FIG. 4 shows a top plan view of an ice suppression mat in another embodiment of the present invention protecting a pile having a floating structure attached thereto.

An ice suppression mat in another embodiment of the invention is shown in FIG. 4 and is generally designated by the numeral 112. The mat 112 may be used with marine piles or other like objects having adjacent or attached floating structures such as, for example, a floating pier or dock which pier or dock is generally designated by the numeral 40. The pier 40 generally has a structure or walkway 44 which is held afloat by a buoyant floatation material 42. The pier 40 is held in the illustrated example to a pile 10 by means of brackets 46,48 or other appropriate attachments so that the pier 40 may rise and fall as the water level rises and falls. The ice suppression mat 112 used in this application is similar in construction and function to the mat described hereinabove except it is modified to fit around the floatation material 42. One such mat 112 arranged to fit around a pier 40 supported by a pile 10 as shown in FIG. 4 is illustrated in FIG. 6.

Figure 6:
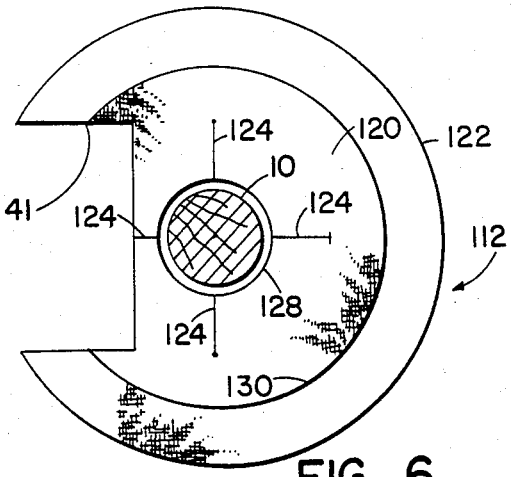
FIG. 6 shows a top plan view of the ice suppression mat of FIG. 4 wherein the floating structure has been removed.

Referring to FIGS. 4 and 6, the mat 112 has an insulating layer 120 and a larger reinforcing layer 122 intimately joined to the insulating layer. The fringe formed by the reinforcing layer 122 extends beyond the edge 130 of the insulating layer 120 and becomes frozen in the surrounding ice sheet 14 during ice formation and functions to anchor the mat 112 to the ice sheet. Slits 124,124 extend radially outwardly from an edge 128 to form pie-shaped segments which provide for bending and deformation at the pile/mat interface. Holes 132,132 through the mat 112 are provided at the ends of the slits 124,124 to relieve stresses during bending of the mat.

As shown in FIG. 6, a section 41 having the shape of the adjacent structure is cut from the mat to permit the mat to surround the supporting pile 10. Referring again to FIG. 4, the ice suppression mat 112 is placed in position around a pile 10 in a similar manner to that as described hereinabove including the stitching together of the reinforcing layer 122. If there is insufficient room for stitching due to overhang of the pier structure 44 or other obstruction, the mat 12 may be secured to the pier 40 by means of two light lines 50,52 having one end of each line attached to the pier structure 44 and having the opposite ends attached to the reinforcing layer 122.

Figure 5:
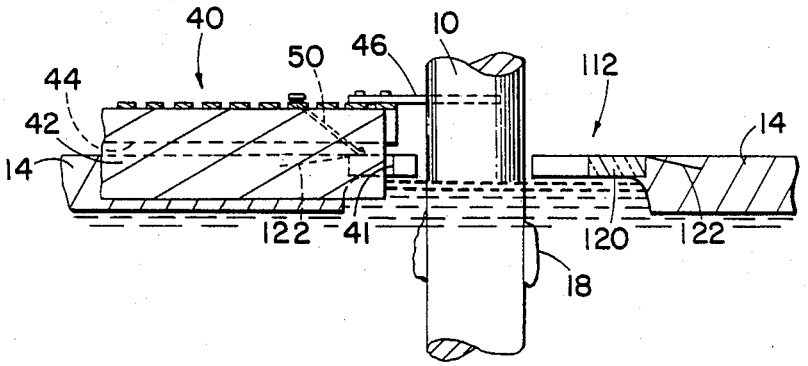
FIG. 5 shows a sectioned side elevation view of the mat and floating structure taken along the line 5—5 of FIG. 4.

Referring now to FIG. 5, a sectioned side elevation view of the pier 40 and the ice suppression mat 112 taken along the line 5—5 of FIG. 4 is shown. As the water level and accordingly the ice sheet 14 rise and fall the mat 112 which is anchored to the ice sheet 14 by the reinforcing layer 122 and the pier floatation material 42 which is also embedded in the ice sheet 14 rise and fall. The ice suppression mat 112 insulates the water below it from the colder air above and prevents ice from adhering to and jacking the pile 10 out of its hole and causing the attached pier 40 to tear away from the pile or otherwise be damaged. As the ice sheet 14 and accordingly the ice suppression mat 112 rise and fall, the mat 112 slides over an ice collar 18 or other irregularities on the pile 10.

Figure 8:
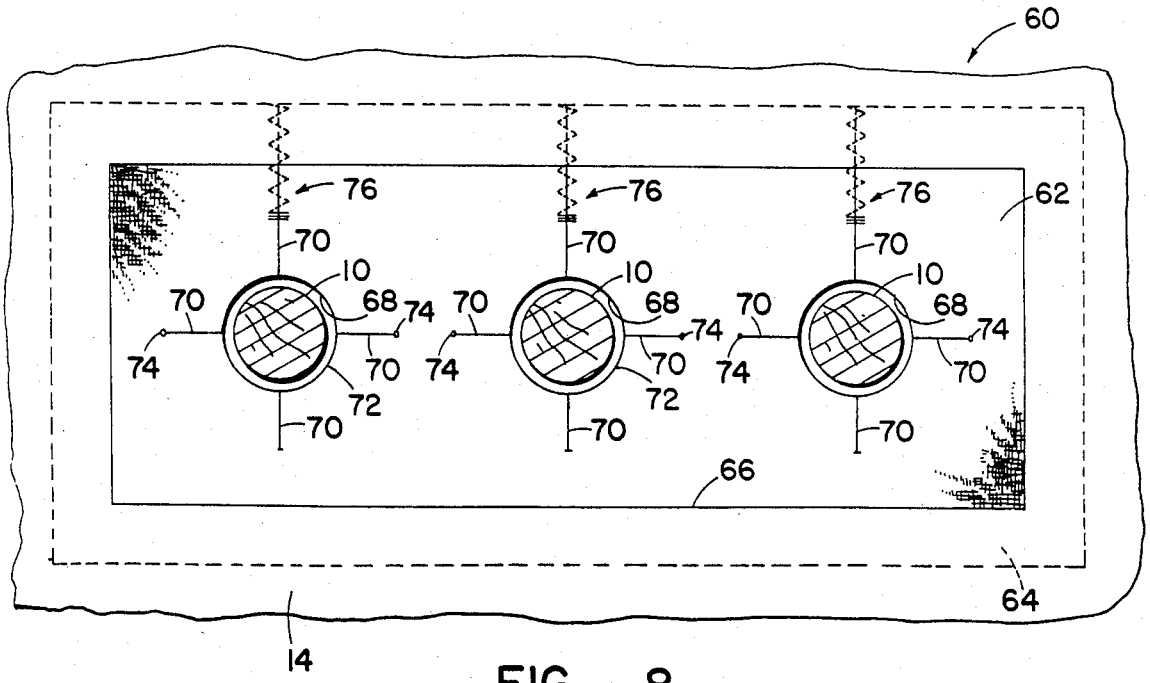
FIG. 8 shows a top plan view of an ice suppression mat in still another embodiment of the present invention as it might be arranged to protect a plurality of adjacent piles.

Referring now to FIG. 8, a top plan view of an ice suppression mat in another embodiment of the present invention is shown as it might be arranged to protect a plurality of adjacent piles. The ice suppression mat is designated generally by the numeral 60 and has an insulating layer 62 and a larger reinforcing layer 64 intimately joined to the insulating layer. The fringe formed by the reinforcing layer 64 extends beyond the edge 66 of the insulating layer 62 and becomes frozen in the surrounding ice sheet 14 during ice formation and functions to anchor the mat 60 to the ice sheet. The mat 60 is arranged with a plurality of openings 68,68 positioned relative to one another to accommodate a like plurality of objects or piles 10,10 having the same positions relative to one another as the openings.

Each of the openings 68,68 has a number of slits 70,70 extending radially outward from an edge 72 of the opening to form pie-shaped segments which provide for bending and deformation at the pile/mat interface. Holes 74,74 are provided through the mat 60 at the ends of the slits 70,70 to relieve stresses during bending of the mat.

To facilitate deployment, one of the slits 70 associated with an opening 68 is cut to extend from the edge 72 of the opening to the outer periphery of the reinforcing layer 64. The mat 60 is opened at the cut and positioned around the pile to be protected. The reinforcing layer 64 is restitched or otherwise fastened together along a portion of the cut. The restitched seam is illustrated generally by the numeral 76 and the seam extends from the outer periphery of the reinforcing layer 64 inward toward the opening 68 for a distance that will leave the slit 70 along the cut equal in length to the other slits 70,70 associated with the opening.

The ice suppression mat of the present invention, unlike prior marine pile protection devices, may be placed in position subsequent to the formation of ice around a pile. In this instance, the mat is arranged to surround a pile with the insulating layer resting on the surface of the surrounding ice sheet. The mat insulates the area directly beneath it from the colder air above and subsequently causes the ice beneath the mat to begin to melt. In order to facilitate adhesion of the fringe of the mat to the ice sheet, the fringe is thoroughly wetted before contact with the ice surface.

While the present invention has been described in several preferred embodiments, it should be understood that numerous modifications and substitutions can be made without departing from the spirit of the invention. For example, the thermal insulating layer may be sandwiched between and bonded to two reinforcing layers and likewise the reinforcing layer may be intermediate and bonded to two thermal insulating layers. Accordingly, the present invention has been described by way of illustration rather than limitation.

I claim:

1. An ice suppression mat for preventing ice from forming adjacent to objects partially submerged in a body of water subject to natural icing conditions, said mat comprising:

a first laminate having one or more layers of a buoyant, thermal insulating material forming a first sheet having a first predetermined surface area;

a second laminate having one or more layers of a flexible, tear resistant reinforcing material forming a second sheet having a second predetermined surface area, said second sheet being intimately joined to said first sheet to form a laminated and reinforced mat, and said second predetermined surface area being larger than said first surface area to provide a fringe of reinforcing material along the outer perimeter of said laminated mat whereby said fringe may become embedded in an ice sheet which forms around said mat such that said mat becomes an integral part of the ice sheet and is caused to move upward and downward about the object as the ice sheet rises and falls, said second surface area being substantially less than the body of water surface area.

2. An ice suppression mat as defined in claim 1 wherein said thermal insulating material is a non-water absorbent material.

3. An ice suppression mat as defined in claim 1 wherein said thermal insulating material is a flexible and non-water absorbent material.

4. An ice suppression mat as defined in claim 3 wherein said thermal insulating material is a closed cell polyethylene foam.

5. An ice suppression mat as defined in claim 1 wherein said laminated mat defines a centrally located opening through the first and second laminates for accommodating a protected object and permitting said mat to move freely with respect to said protected object as the water level rises and falls.

6. An ice suppression mat as defined in claim 5 wherein said laminated mat has means defining a slit extending radially outward for a predetermined distance from said opening in said mat to permit deformation of the edge of said opening as said mat moves over irregularities or ice formations on the surface of said protected object.

7. An ice suppression mat as defined in claim 6 wherein said predetermined distance of said slit is not greater than one half the distance from said edge of said opening to an outer edge of said mat.

8. An ice suppression mat as defined in claim 6 wherein said laminated mat includes a plurality of means defining a slit wherein one of said slits extends from the edge of said opening in said mat to the outer edge of said reinforcing sheet so that said mat may be separated at said fully extended slit to allow the mat to be placed about the protected object when the object is constructed so as to prevent placing said mat over the object and dropping into position; and, wherein said mat further includes means for fastening said mat together at said fully extended slit after said mat has been placed in position about the protected object.

9. An ice suppression mat as defined in claim 5 wherein said laminated mat is adapted to a circular configuration and the diameter of said mat is at least three times the diameter of said opening.

10. An ice suppression mat as defined in claim 1 wherein said reinforcing sheet extends past said insulating sheet to form a fringe having a width of at least six inches.

11. An ice suppression mat as defined in claim 1 wherein said reinforcing material is bonded to said thermal insulating material.

12. An ice suppression mat as defined in claim 1 wherein said reinforcing material is mechanically attached at one surface of said thermal insulating material.

13. An ice suppression mat as defined in claim 1 wherein said laminated mat defines a plurality of openings through the first and second laminates for accommodating a plurality of protected objects and permitting said mat to move freely with respect to said plurality of objects as the water level rises and falls.

14. A method of mounting an ice suppression mat around an object partially submerged in a body of water comprising the steps of:

providing a laminated ice suppression mat having a first laminate of buoyant, thermal insulating material and a second laminate of a flexible, tear resistant material intimately joined to said first laminate , said mat further defining a centrally located opening through the first and second laminates, cutting the insulating layer from one outer edge through the centrally located opening to an opposite outer edge along a half section seam to form two half sections, cutting the reinforcing layer along a part of the half section seam from an edge of the central opening to one of the outer edges of the mat so that the two half sections are separated completely along the cut part of the half section seam and remain attached by the reinforcing material along the uncut part of the half section seam, folding the mat along the half section seam so that each of the two half sections are in a plane substantially parallel to one another, spreading portions of the folded mat along the cut part of the half section seam, moving the object and the mat relative to one another so that the object in the water moves between the spread portions of the mat and the mat moves into enveloping relationship with the object and the object is situated between the half sections and extends through the central opening, unfolding the mat so that the two half sections lie generally in a common plane and surround the object extending through the central opening, and refastening the reinforcing layer along the cut part of the half section seam.

15. An ice suppression mat for preventing an ice sheet from forming around and adhereing to a marine pile partially submerged in a body of water subject to natural icing conditions, said mat comprising:

a first laminate having one or more layers of a bouyant, thermal insulating material forming a first sheet having a first predetermined surface area;

a second laminate having one or more layers of a flexible, tear resistant reinforcing material forming a second sheet having a second predetermined surface area, said second sheet being intimately joined to said first sheet to form a laminated and reinforced mat;

said laminated mat defining a centrally located opening through the first and second laminates for accommodating a marine pile to be protected and permitting said mat to move axially along said protected pile as the water level rises and falls;

said second predetermined surface area being larger than said first surface area to provide a fringe of reinforcing material along the outer perimeter of said laminated mat whereby said fringe may become embedded in an ice sheet which forms around said mat such that said mat becomes an integral part of the ice sheet and moves axially along said protected marine pile as said ice sheet rises and falls, said second surface area being substantially less than the body of water surface area, and said laminated mat has means defining a slit extending radially outward for a predetermined distance from said opening in said mat, said mat having a plurality of said radial slits to permit deformation of the edge of said opening as said mat moves over irregularities or ice formations on the surface of said pile.

16. An ice suppression mat as defined in claim 15 wherein said predetermined distance of said slit is not greater than one half the distance from said edge of said opening to an outer edge of said mat.

17. An ice suppression mat as defined in claim 15 wherein said laminated mat is adapted to a circular configuration and the diameter of said mat is at least three times the diameter of said opening.

18. An ice suppression mat as defined in claim 15 wherein said reinforcing sheet extends past said insulating sheet to form a fringe having a width of at least six inches.

19. An ice suppression mat as defined in claim 15 wherein said laminated mat defines a plurality of openings through the first and second laminates for accommodating a plurality of marine piles to be protected and permitting said mat to move axially along said plurality of protected piles as the water level rises and falls.

* * * * *